US006060651A

United States Patent [19]

Basmadjian

[11] Patent Number: 6,060,651

[45] Date of Patent: May 9, 2000

[54] DRUM SHELL

[76] Inventor: Edouard Basmadjian, 12205 Le Mesurier, Montreal, Quebec, Canada, H4K 2B2

[21] Appl. No.: 09/158,779

[22] Filed: Sep. 23, 1998

[51] Int. Cl.[7] ..... G10D 13/02

[52] U.S. Cl. ..... 84/411 R

[58] Field of Search ..... 84/411 R–421, 84/411 A, 411 M, 411 P

[56] References Cited

U.S. PATENT DOCUMENTS

| | | | |
|---|---|---|---|
| 511,126 | 12/1893 | Converse | 84/411 R |
| 1,768,438 | 6/1930 | Clark | 84/412 |
| 3,685,389 | 8/1972 | Bemben | 84/411 R |
| 4,520,709 | 6/1985 | Kester | 84/415 |
| 4,589,323 | 5/1986 | Belli et al. | 84/411 R |
| 5,042,356 | 8/1991 | Karch | 84/411 R |

OTHER PUBLICATIONS

"Drum Workshop Custom Snare Drum Collection Far Beyond The Basics" DW 1995 Advertising Pamphlet.

*Primary Examiner*—Stanley J. Witkowski
*Attorney, Agent, or Firm*—Swabey Ogilvy Renault; Robert Mitchell

[57] ABSTRACT

A device for increasing the variety of sounds available from a percussive musical instrument having a generally cylindrical drum shell. The device comprises at least one hollow cylindrical body dimensioned and configured to be axially received within the drum shell between opposed ends thereof. The hollow cylindrical body and the drum shell may be made of similar or different materials. The hollow cylindrical body can be directly mounted to an inner surface of the drum shell or, alternatively, to a number of spacers arranged at circumferentially spaced-apart locations on the inner surface of the drum shell.

18 Claims, 2 Drawing Sheets

DRUM SHELL

BACKGROUND OF THE INVENTION

1. Field of the Invention

The present invention relates to percussive musical instruments and, more particularly, pertains to a new drum shell structure.

2. Description of the Prior Art

In the past, conventional drum shells were made of a single piece of material, such as wood, bronze, brass, fiber glass or metal. In order to simultaneously benefit from the sound properties of these materials, efforts have been made to design composite drum shells. For instance, Drum Workshop Inc. has developed a snare drum which includes a drum shell composed of cylindrical sections disposed in axially end-to-end relationship. More particularly, the drum shell is constructed from lower and upper end sections of brass and a central section of wood. The central section is provided at opposed ends thereof with upper and lower annular tenons which are respectively shaped to fit into corresponding annular mortises defined in the lower edge of the upper end section and the upper edge of the lower end section.

Although the above-described composite drum shell is effective, it has been found that there is a need for a new, simpler and less costly alternative composite drum construction.

Additionally, it would also be highly beneficial to provide an auxiliary drum structure which could be retrofitted to an existing percussive musical instrument or drum for enhancing the acoustic properties thereof.

SUMMARY OF THE INVENTION

It is therefore an aim of the present invention to provide a new composite drum structure.

It is also an aim of the present invention to provide a composite drum structure which is relatively simple and economical to manufacture.

It is a further aim of the present invention to provide a device which can be readily installed in an existing drum structure to modify the sound thereof.

Therefore, in accordance with the present invention, there is provided a device for modifying the sound of a percussive musical instrument having a generally cylindrical drum shell, said device comprising at least one hollow cylindrical body dimensioned and configured to be axially mounted within the drum between first and second opposed ends thereof, said hollow cylindrical body having opposed first and second outer edges, said first and second opposed outer edges being respectively spaced from the first and second opposed ends of the drum shell.

In accordance with a further aspect of the present invention, there is provided a kit for modifying the sound of an existing percussive musical instrument provided with a generally cylindrical drum shell having opposed ends. The kit comprises at least one flexible strip adapted to be disposed in a substantially cylindrical configuration within the drum shell, and mounting means for installing said flexible strip to the drum shell at a location where said flexible strip is spaced from the opposed ends of the drum shell.

In accordance with a further general aspect of the present invention, there is provided a drum structure for a musical percussion instrument, comprising an outer drum body having at opposed ends thereof annular bearing edges, at least one inner drum body dimensioned and configured to fit within said outer drum body between said opposed ends thereof, said outer and inner drum bodies having parallel longitudinal axes, fastening means for attaching said inner and outer drum bodies together, drum head means adapted to be mounted on said bearing edges, and retaining means coupled to an outer surface of said outer drum body for maintaining said drum head means against said annular bearing edges of said outer drum body.

BRIEF DESCRIPTION OF THE DRAWINGS

Having thus generally described the nature of the present invention, reference will now be made to the accompanying drawings, showing by way of illustration a preferred embodiment thereof, and in which.

DESCRIPTION OF THE PREFERRED EMBODIMENTS

Figure 1:
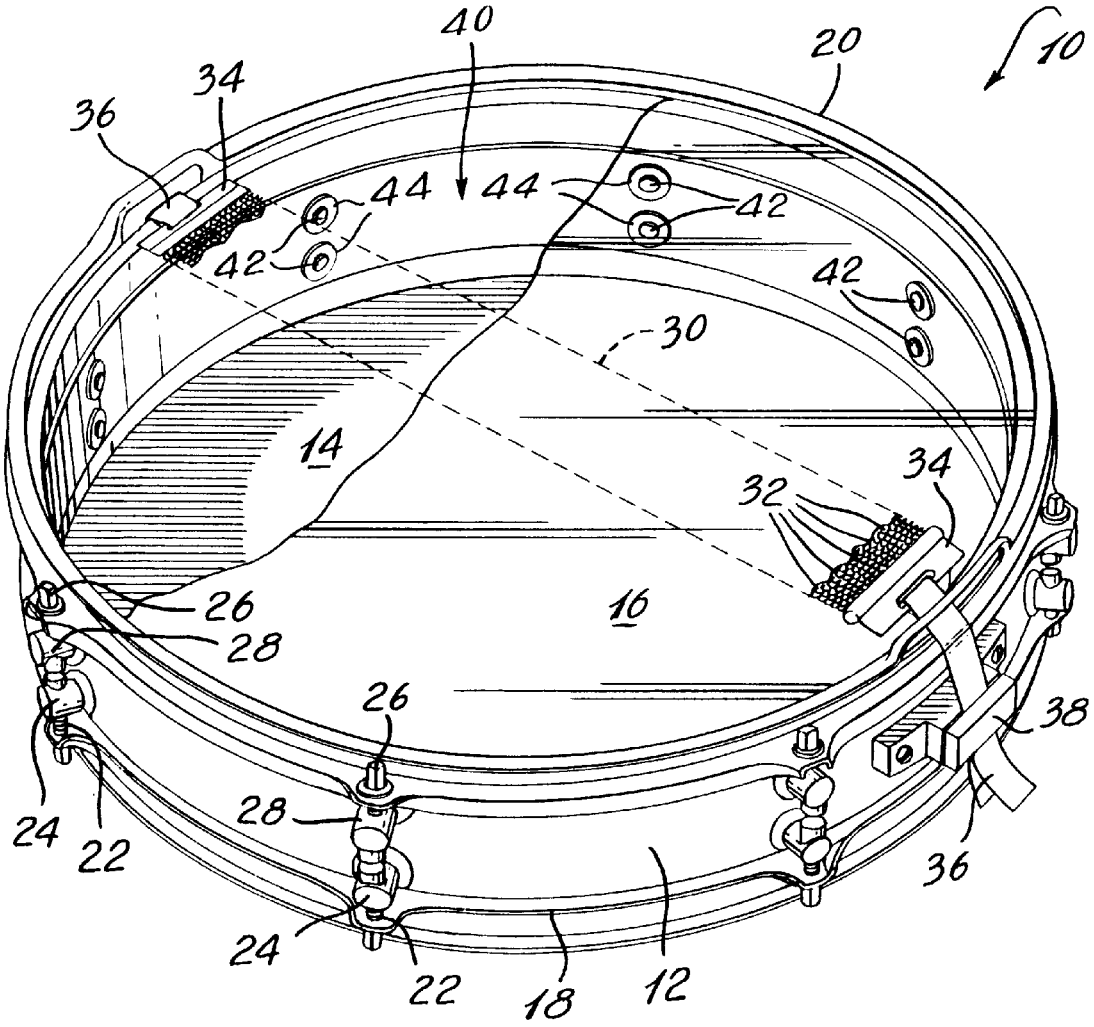
FIG. 1 is a perspective view of a snare drum having a multiple shell structure in accordance with a first embodiment of the present invention.

Now referring to the drawings, and in particular to FIG. 1, a snare drum 10 having a multiple drum shell structure will be described.

More specifically, the snare drum 10 includes a hollow cylindrical outer shell 12, and batter and snare heads 14 and 16 mounted on annular bearing edges formed at opposed ends of the outer shell 12. The snare drum 12 further includes first and second rims 18 and 20 adapted to respectively engage the peripheral edge of the batter head 14 and of the snare head 16.

A number of tuning rods 22 extend through apertures defined in the first rim 18 and threadably engage associated lugs 24 secured at uniform interval on the exterior side of the outer shell 12. By means of this arrangement, the tuning rods 22 and the lugs 24 cooperate to pull the first rim 18 toward the second rim 20, thereby applying and maintaining centrifugal tension to the batter head 14 along the peripheral edge thereof. The tuning of the batter head 14 is accomplished by screwing the tuning rods 22 into the lugs 24.

Similarly, a number of tuning rods 26 extend through apertures defined in the second rim 20 and threadably engage associated lug 28 mounted on the exterior side of the outer shell 12 to maintain the snare head 16 under tension.

A conventional snare 30 is provided above the outer surface of the snare head 16. The snare 30 consists of multiple parallel strands 32 connected at opposed ends thereof to respective attachment members 34. Each attachment member 34 is provided with a plastic band 36 which is engaged with a conventional snare strainer 38 mounted on the exterior surface of the outer shell 12. As is well known in the art, the snare strainers 38 may be operated to vary the position of the snare 30 relative to the snare head 16 to produce different types of sounds when the batter head 14 is struck by a drum stick or brush (not shown).

Disposed internally of the outer shell 12 is an inner shell 40. According to the embodiment illustrated in FIG. 1, the outer and inner shells 12 and 40 are made of different materials. For instance, the outer shell 12 can be made of wood and the inner shell 40 of brass or vice versa. Other commonly used materials are: brass, bronze, aluminium, steel, carbon steel, fiber glass, etc. However, it is understood that other materials having interesting acoustic and structural properties may be incorporated in the production of the outer and inner shells 12 and 40.

Accordingly, the outer and inner shells 12 and 40 may be made out of various combinations of materials to produce a snare drum which combines the acoustic properties of different materials in a single drum. For instance, an outer brass shell would increase the higher frequencies, power and bite in the sound emitted from the snare drum 10, while an inner maple shell would provide warmth and body to the sound of the instrument.

As seen in FIG. 1, the inner shell 40 is directly mounted to an inner circumference of the outer shell 12 by means of the screws 42 used to secure the lugs 24 and 28 to the exterior surface of the outer shell 12. By doing so, the number of pieces to assemble is minimised and consequently the weight added to the snare drum 10 and the production cost thereof are reduced.

More particularly, each screw 42 is inserted in succession through a washer 44, a lock washer, a radial aperture (not shown) defined in the inner shell 40, a radial aperture (not shown) defined in the outer shell 12 and finally in a threaded hole (not shown) defined in one of the lugs 24, 28 where the screw 42 is threadably engaged with the threaded hole of the lug 24, 28 to secure the same on the exterior surface to the outer shell 12. It is understood that the series of apertures of the inner and outer shells 12 and 40 are configured and disposed to be in phase to provide passages for the screws 42.

The inner shell 40 may consist of a continuous cylindrical body or, alternatively, of an elongated strip adapted to be mounted in a substantially cylindrical configuration within the outer shell 12. In the event that the inner shell is manufactured as a cylindrical body and that it is desired to mount the same onto the inner surface of the outer shell 12, as illustrated in FIG. 1, the external diameter of the inner shell 40 will generally correspond to the internal diameter of the outer shell 12.

However, if the inner shell 40 is provided in the form of an elongated strip, then its length may be equal, slightly less or more than the internal circumference of the outer shell 12. It is understood that when the length of the elongated strip is smaller than the internal diameter of the outer shell 12, the elongated strip will only form a partial loop after having been installed on the inner surface of the outer shell 12. If the length of the elongated strip is equal to the internal diameter of the outer shell 12, then the elongated strip will form a complete loop on the inner surface of the outer shell 12. Finally, if the length of the elongated strip is greater than the internal circumference of the outer shell 12, the opposed ends of the strip will overlap once the strip is mounted to the inner surface of the outer shell 12. One advantage of using an elongated strip instead of a pre-formed cylindrical body resides in the fact that it may be adapted to snare drums having different diameters. However, both configurations are contemplated.

It is understood that in the event that the inner shell 40 is not pre-assembled in a cylindrical configuration, slots are defined in the strips instead of holes to allow for the alignment of the slots with the lug casings.

The inner shell 40 may be sold as an auxiliary drum structure to be retrofitted to an existing snare drum or simply incorporated in the construction of a new snare drum. Accordingly, the present invention provides a means to enhance or alter the sound of an existing drum at a relatively low cost when compared to the cost of purchasing a high quality snare drum.

The outer and inner shells 12 and 40 may be of any thickness or depth. However, the longitudinal dimension or depth of the inner shell 40 must always be inferior to that of the outer shell 12, as the inner shell 12 must not be in contact with the batter and snare heads 14 and 16 of the snare drum 10. Accordingly, unlike the outer shell 12, the inner shell 40 does not require a bearing edge, whereby the manufacturing costs are considerably decreased when compared to the other multi-sectional drum shells.

It is also contemplated to install more than one inner shell 40 within the outer drum shell 12. The inner shells would be fitted one into the other. Alternatively, inner shells of similar diameters could be mounted in an end-to-end or spaced-apart longitudinal relationship on the inner surface of the outer shell 12. The inner shells may be of similar or different materials, thickness and depths to create an instrument with unique acoustic properties.

Figure 2:
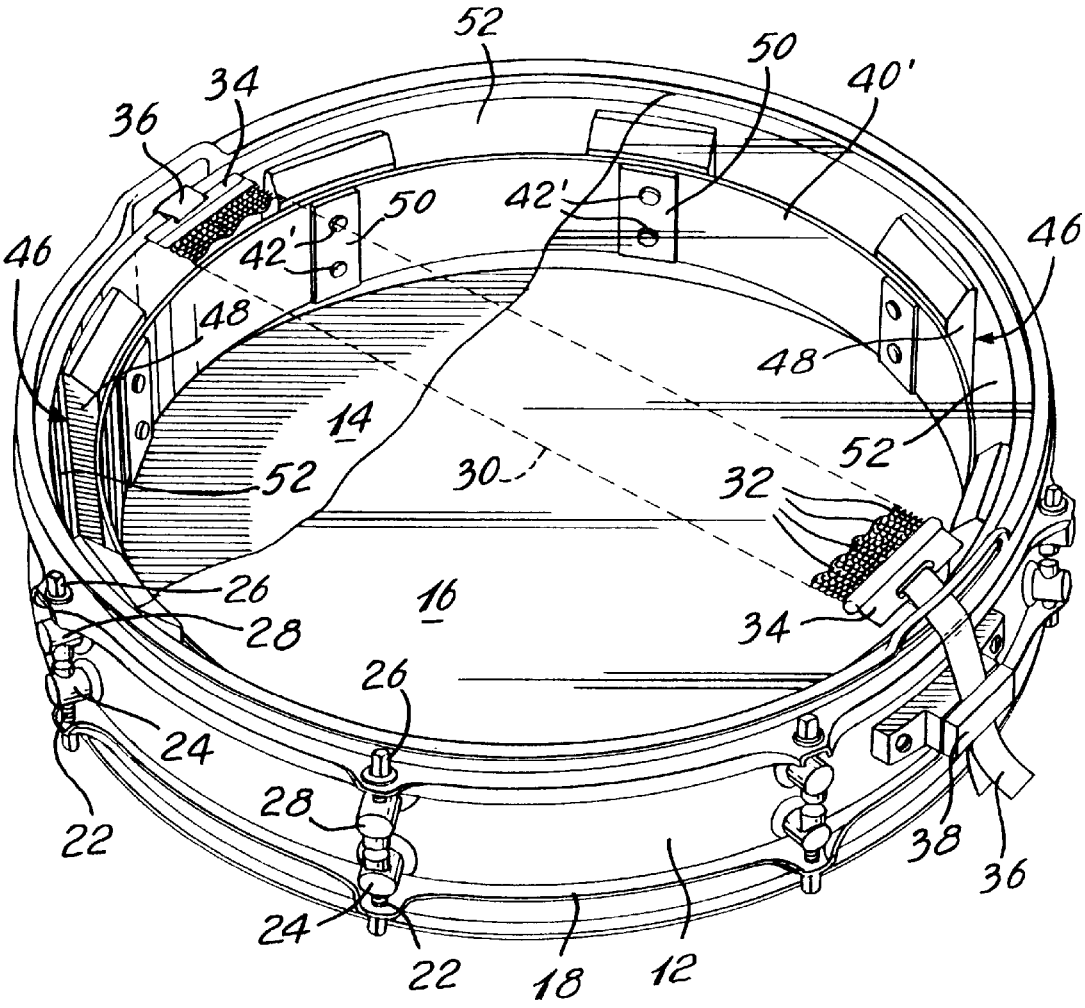
FIG. 2 is a perspective view of a snare drum having a multiple shell structure in accordance with a second embodiment of the present invention.

FIG. 2 illustrates a second embodiment of the present invention, wherein a plurality of spacers 46 are disposed between the inner shell 40' and the outer shell 12. According to the illustrated embodiment, a spacer 46 is provided at each connection of the inner shell 40' with the outer shell 12, which also corresponds to the connection of the lugs 24, 28 with the outer shell 12, as described hereinbefore.

According to one embodiment of the present invention, the spacers 46 consist of wood blocks 48 having a concave side conforming to the outer circumference of the inner shell 40' and an opposed convex side adapted to follow the inner circumference of the outer shell 12. Each wood block 48 defines two longitudinally spaced-apart holes (not shown) which are adapted to be placed in coaxial alignment with one of the pairs of lug holes defined in the outer shell 12. Accordingly, during the assembly process, each pairs of screws 42', which are used to secure the lugs 24, 28 to the outer shell 12, are inserted in succession through a flat plate 50, the inner shell 40', one of the wood blocks 48, the outer shell 12 and then threadably engaged with respective lugs 24, 28.

It is understood that the thickness of the wood blocks 48 corresponds to the difference between the outer diameter of the inner shell 40' and the inner diameter of the outer shell 12. In order to increase the reverb and resonance of the snare drum 10 without sacrificing crispness or sensitivity, the thickness of the wood block 48, i.e. the distance between the inner shell 40' and the outer shell 12, must be at most in the order of ½ inch. For instance satisfactory results have been obtained with a 4"×14" maple outer shell and a 2½"×13" brass inner shell. Generally, it can be said that the amount of body and reverb generated by the drum's sound increases with the distance between the outer and inner shells 12 and 40'. Accordingly, the distance between the outer and inner drum shells 12 and 40' must not be too considerable, as it may result in a sound which is sloppy or muddy with a substantial lack of attack.

It is noted that the inner shell 40' and the outer shell 12 may be constituted of the same material, as adjacent wood blocks 48 form with the outer shell 12 and the inner shell 40' a purality of chambers 52 which contribute to increase the tone and reverb generated from the sound of the snare drum 10.

Each wood block 48 may be provided with opposed bevelled ends in order to follow the angle of the bearing edges of the outer drum shell 12.

It is noted that rubber washers or machined blocks of other materials than wood may be used as a substitute for the wood blocks 48.

As for the first embodiment, it is contemplated to install more than one inner shell 40' within the outer shell 12. For instance, in order to provide more reverb, a third shell of a smaller diameter could be installed within the inner shell 40'.

Furthermore, inner shells having similar or different diameters may be mounted in an end-to-end or spaced-apart longitudinal relationship on the inner surface of the outer shell 12. For instance, an inner shell 40 and an inner shell 40' of different diameters may be mounted on the inner surface of the outer shell 12. The inner shells 40 and 40' may be of similar or different materials, thickness and depths to create an instrument with unique acoustic properties.

It is also understood that the second preferred embodiment may be retrofitted to an existing instrument.

Finally, although the present invention has been described in the context of a snare drum, it is understood that it may be applied to other percussive musical instruments.

What is claimed is:

1. A device for changing the musical sound property of a percussive musical instrument having a generally cylindrical drum shell, said device comprising at least one hollow cylindrical body dimensioned and configured to be axially and concentrically mounted within the drum shell between first and second opposed ends thereof to form with said drum shell a multiple-shell structure having tonal characteristics resulting from the combination of respective tonal characteristics of said drum shell and said hollow cylindrical body, said hollow cylindrical body having opposed first and second outer edges, said first and second opposed outer edges being respectively spaced from the first and second opposed ends of the drum shell, and wherein said hollow cylindrical body is entirely surrounded between said first and second outer edges thereof by said drum shell.

2. A device as defined in claim 1, wherein said hollow cylindrical body is made of a different material than that of the drum shell.

3. A device as defined in claim 2, wherein said hollow cylindrical body is made of a material selected from a group containing: wood, brass, bronze, steel, carbon steel and fiber glass.

4. A device as defined in claim 1, further comprising spacer means adapted to be mounted between said hollow cylindrical body and the drum shell.

5. A device as defined in claim 4, wherein said spacer means include a plurality of spacers distributed along an outer circumference of said hollow cylindrical body.

6. A device as defined in claim 1, wherein a plurality of screws radially extend through the drum shell and threadably engage lugs to secure the same onto an outer circumference of the drum shell, and wherein a plurality of radial apertures are defined at circumferentially spaced-apart locations in said cylindrical body to receive therethrough the screws used to secure the lugs on the outer circumference of the drum shell in order to attach said cylindrical body to said drum shell.

7. A device as defined in claim 1, wherein said cylindrical body has an outer circumference which is contiguous to an inner circumference of the drum shell.

8. An auxiliary drum structure for retrofitting an existing percussive musical instrument provided with a generally cylindrical drum shell having opposed ends, comprising at least one strip adapted to be concentrically disposed in a substantially cylindrical configuration within the drum shell to form therewith a multiple-shell structure having tonal characteristics resulting from the combination of respective tonal characteristics of said drum shell and said strip, and mounting means for installing said strip to the drum shell at a location where said strip is spaced from the opposed ends of the drum shell and completely contained therein.

9. An auxiliary drum structure as defined in claim 8, wherein said mounting means comprise spacer means adapted to be disposed between said strip and the drum shell.

10. An auxiliary drum structure as defined in claim 8, wherein said strip defines a plurality of slot means which are disposed to be coaxially aligned with existing transversal holes defined at circumferentially spaced-apart locations in the drum shell, whereby fasteners may be inserted through said slot means of said strip and through the transversal holes of the drum shell to secure said strip to the drum shell.

11. An auxiliary drum structure as defined in claim 9, wherein said strip and said spacer means define a plurality of apertures which are disposed to be coaxially aligned with existing transversal holes defined at circumferentially spaced-apart locations in the drum shell, and wherein said mounting means further include fasteners adapted to be inserted through said apertures of said strip and said spacer means and through said transversal holes of the drum shell to secure said strip and said spacer means to the drum shell.

12. A drum structure for a musical percussion instrument, comprising an outer drum body having at opposed ends thereof annular bearing edges, at least one inner drum body dimensioned and configured to fit within said outer drum body between said opposed ends thereof, said outer and inner drum bodies being concentrically disposed with said outer drum body completely surrounding said inner drum body, fastening means for attaching said inner and outer drum bodies together to form a multiple-shell structure having tonal characteristics resulting from the combination of respective tonal characteristics of said outer drum body and said inner drum body, drum head means adapted to be mounted on said bearing edges, and retaining means coupled to an outer surface of said outer drum body for maintaining said drum head means against said annular bearing edges of said outer drum body.

13. A drum structure as defined in claim 12, wherein said outer and inner drum bodies are made of a different material.

14. A drum structure as defined in claim 13, wherein said outer and inner drum bodies are made of a combination of material selected from a group containing: wood, brass, bronze, steel, carbon steel and fiber glass.

15. A drum structure as defined in claim 12, wherein spacer means are provided between said inner and outer drum bodies.

16. A drum structure as defined in claim 15, wherein said spacer means include a plurality of spacers disposed at interval between said inner and outer drum bodies.

17. A drum structure as defined in claim 12, wherein said fastening means only include non-adhesive fastening means.

18. A drum structure as defined in claim 12, wherein said outer and inner drum bodies are made of a similar material.

* * * * *